United States Patent [19]

Hardy

[11] Patent Number: 4,796,764

[45] Date of Patent: Jan. 10, 1989

[54] DIVIDER FOR MERCHANDISE DISPLAY

[75] Inventor: Stephen N. Hardy, Copley, Ohio

[73] Assignee: American Greetings Corporation, Cleveland, Ohio

[21] Appl. No.: 112,668

[22] Filed: Oct. 22, 1987

[51] Int. Cl.[4] ..... A47F 5/00

[52] U.S. Cl. ..... 211/184; 211/55

[58] Field of Search ..... 211/184, 55, 129; 108/60, 61

[56] References Cited

U.S. PATENT DOCUMENTS 2,869,732 1/1959 Ganz ..... 211/55
3,139,186 6/1964 George ..... 211/55
3,285,424 11/1966 Emery ..... 211/184 X
3,298,538 1/1967 Ganz et al. ..... 211/55 X
3,612,292 10/1971 Nervig ..... 211/184

*Primary Examiner*—Robert W. Gibson, Jr.
*Attorney, Agent, or Firm*—Calfee, Halter & Griswold

[57] ABSTRACT

A divider structure for subdividing a display space in a merchandise display such as a greeting card display. The divider structure is preferably a molded plastic divider structure, designed to be attached to a wall of the merchandise display in a number of different orientations. The divider structure enables a pair of the dividers to be attached to a single merchandise display wall to subdivide the display spaces on opposite sides of the wall into segments of any desired sizes.

26 Claims, 3 Drawing Sheets

DIVIDER FOR MERCHANDISE DISPLAY

INTRODUCTION

The present invention relates to a divider structure for subdividing a display space in a merchandise display such as a greeting card display. More particularly, the invention relates to a divider structure, preferably a molded plastic divider structure, designed to be attached to a wall of a merchandise display in a number of different orientations. With the present invention a pair of the divider structures can be attached to a single merchandise display wall to subdivide the display spaces on opposite sides of the wall into segments of any desired sizes.

BACKGROUND

A popular type of merchandise display for greetings cards consists of staggered, offset rows of shelves and walls which support and display stacks of the greeting cards in a cascading, tiered fashion. In such a merchandise display, display spaces are disposed on both sides of each of the walls, and stacks of greeting cards are supported and displayed from the display spaces.

The display of stacks of merchandise in a cascading, tiered fasion enables consumers to remove individual articles from the stacks and to inspect the articles prior to purchasing them. Thus, it is desirable to try and maintain the stacks in a neat, orderly fashion in the display. It is also desirable to encourage consumers to return articles properly into the stacks in the event they do not purchase the articles. For both such purposes, it has been found useful to provide divider structures for dividing the display spaces on both sides of the walls into segments, each segment being of a predetermined size to accomodate a stack of the articles.

One type of divider that has been used with such types of merchandise displays is shown in U.S. Pat. No. 3,612,292 which is owned by the assignee of this invention. The divider comprises an attachment member for resiliently engaging the upper end of of a display wall, and a divider tongue extending from the attachment member into the display space behind the wall to separate the display space behind the wall into segments.

Another type of divider for a merchandise display is shown in U.S. Pat. No. 3,002,632. The divider includes a relatively flat base plate, a clip for securing the base plate to a display wall and a divider tongue extending from the base plate into a display space on one side of the display wall. The base plate, in addition to forming part of the divider structure, carries a rolled edge which enables the base plate to support a reorder tag for the merchandise. Thus, when a stack of cards in the merchandise display is exhausted, the reorder tag serves as a reminder to a merchant to replenish the cards of that stack. It is useful to positively support the reorder tags on the divider so that the reorder tags are not loosely placed behind the stacks of cards.

In a cascading, tiered merchandise display for articles such as greeting cards, there is often a problem in dividing the two display spaces at the top end of the display. Specifically, the back wall of the display usually extends well above the topmost display space; hence, it cannot properly support a divider of the type shown in either of U.S. Pat. Nos. 3,612,292 or 3,002,632. Thus, the topmost display wall must serve as the support for dividers extending to both sides of that display wall. With dividers of the type shown in U.S. Pat. Nos. 3,612,292 or 3,002,632, it is not possible to selectively locate dividers in any desired locations on opposite sides of the top display wall.

SUMMARY OF THE PRESENT INVENTION

The present invention provides a new and useful divider structure for a merchandising display. The divider structure of the present invention is designed to be attached to a display wall in a number of different orientations. Moreover, the divider structure is designed to enable a pair of dividers to be attached to a single display wall, with the divider tongues located at any desired locations on opposite sides of the display wall. Thus, in a merchandise display such as a card rack, a pair of dividers can be attached to the top display wall with their divider tongues at any selected locations on both opposite sides of the display wall.

According to the preferred embodiment, the divider includes a divider tongue, an attachment means for attaching the divider tongue to a display wall, and a paper clip portion for securing a reorder tag. The attachment means comprises a unique H-shaped member, and the divider tongue is secured in a special offset relation to the H-shaped member. The H-shaped member and the offset divider tongue are designed to enable the divider to be secured in many orientations to the upper end of a display wall, and to enable two such dividers to be secured to the same display wall with their tongues in any desired locations on opposite sides of the display wall.

Still another unique feature of the divider is the structure and location of the paper clip for securing a reorder tag to the divider. More specifically, the divider is preferably a molded plastic article comprising essentially the divider tongue, the H-shaped attachment member and the paper clip. The paper clip includes a pair of spaced apart fingers resiliently biased toward an outer wall of the attachment member. The paper clip is designed to resiliently engage a reorder tag to positively secure the reorder tag to the divider. The paper clip is integrated into the divider in such a way as to minimize the size of the molded plastic divider and the amount of material required to make the divider.

Additional aspects of the preferred embodiment of this invention relate to the specific structure of the paper clip and to the manner in which the attachment means secures the divider to a display wall. The design of the attachment means produces a cocking action that helps to more effectively secure the divider to the wall. The paper clip structure is specially designed to facilitate its molding, and is also designed to produce a desired bow in the reorder tag to more effectively secure the reorder tag to the divider.

Still further, the preferred embodiment of the present invention provides a molded plastic divider which has all of the foregoing features, and yet is believed to minimize the size of the elements of the divider and the amount of material required to construct the divider. Thus, the molded plastic divider is believed to be very cost and material efficient.

Further objects and advantages of the present invention will become further apparent from the following detailed description and to the accompanying drawings.

DETAILED DESCRIPTION OF THE PREFERRED EMBODIMENT

Figure 1:
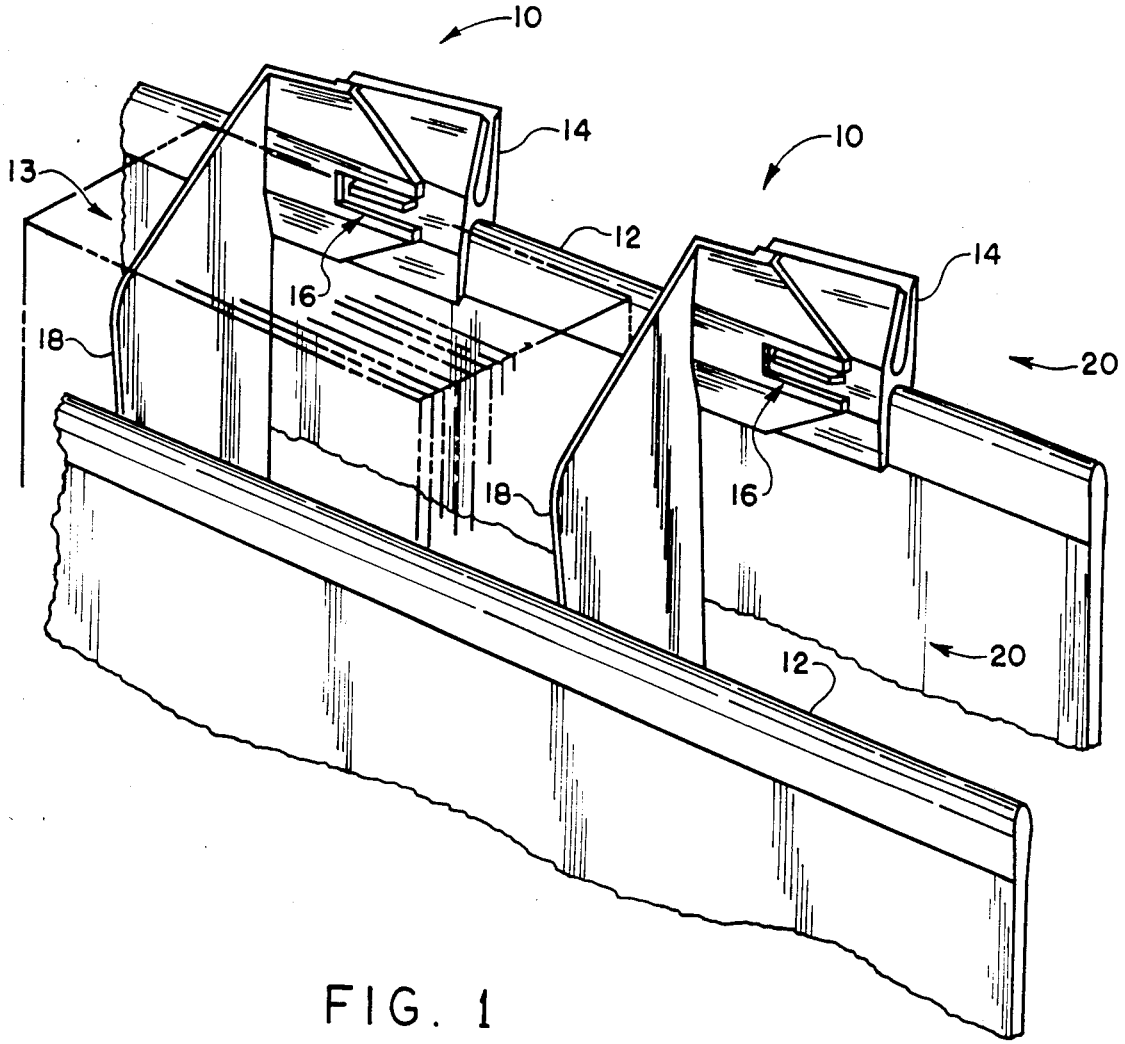
FIG. 1 is a perspective view of a merchandise display for greeting cards, with several dividers according to the present invention secured to the top wall of a merchandise display shelf.

As discussed above, the present invention relates to a divider structure for a merchandise display such as a greeting card display. FIG. 1 illustrates several dividers 10, each constructed according to the present invention, secured to one of a series of display walls 12 of a merchandise display for articles such as greeting cards. In such a merchandise display, a staggered, offset array of display shelves (not shown) are typically formed both forward and rearward of the display walls 12. The display shelves and the display walls support stacks of articles, such as greeting cards 13, in cascading, tiered relationship in order to make the stacks of merchandise relatively easy to view and inspect.

In FIG. 1, several dividers 10 constructed according to the preferred embodiment are shown attached to one of the display walls 12. Each divider 10 essentially comprises an attachment portion 14 which engages the display wall 12, a paper clip 16 which engages a reorder tag, and a divider tongue 18 which extends into either of a pair of display spaces 20 disposed on opposite sides of the display wall 12. The divider tongue 18 divides either display space 20 into segments of predetermined size. According to the preferred embodiment, the entire divider (including the divider tongue, the attachment portion and the paper clip) is formed as a single molded plastic article. The plastic material would preferably be durable, flexible, impact resistant and relatively inexpensive. Homopolymers of polypropylene are believed to have such characteristics.

Figure 2:
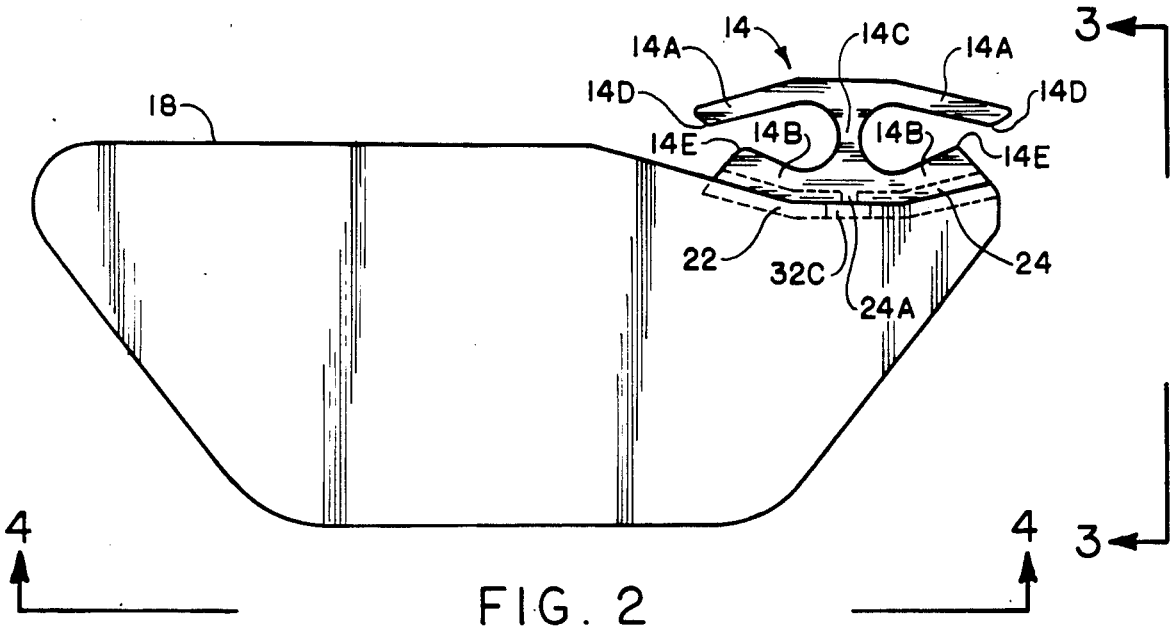
FIG. 2 is an elevational view of one side of a divider according to the present invention.
Figure 3:
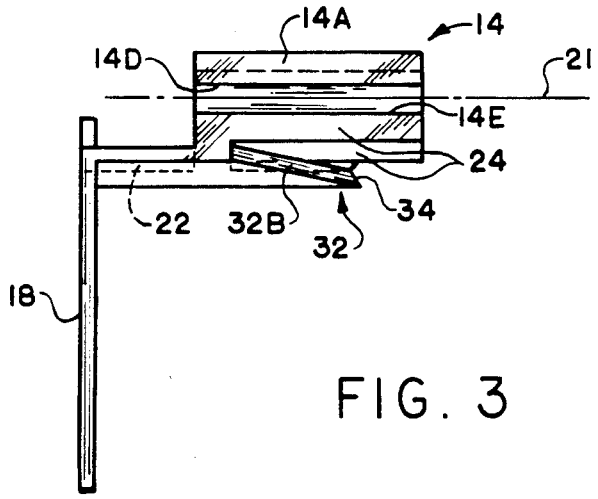
FIG. 3 is an elevational view of the divider of FIG. 2, taken from the direction 3—3.
Figure 4:
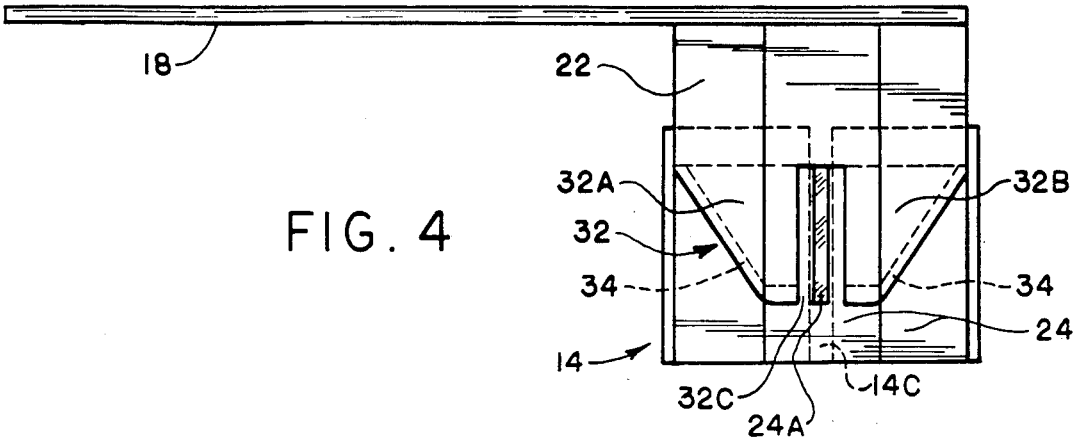
FIG. 4 is an elevational view of the divider of FIG. 2, taken from the direction 4—4.

FIGS. 2–4 illustrate the details of the divider structure. The attachment portion 14 is a longitudinally extending member having a generally H-shaped profile with two sets of legs 14A, 14B for resiliently securing the divider to the display wall 12. Each set of legs 14A, 14B extends away from a central portion 14C, and each set of legs has a pair of distal gripper portions 14D, 14E for engaging the opposite sides of a display wall 12. Thus, either set of legs 14A, 14B can be resiliently secured to a display wall 12, to secure the divider to the display wall.

The divider tongue 18 is preferably a planar member which is offset from the attachment portion 14. More specifically, the attachment portion 14 has a longitudinal axis 21 (see FIG. 3), and the divider tongue 18 is offset, both longitudinally and laterally, with respect to the attachment portion. By "longitudinally and laterally" offset it is meant that the divider tongue is located longitudinally and laterally beyond the attachment portion 14 (see FIG. 3). An intermediate portion 22 of the molded divider extends between the divider tongue 18 and the attachment portion 14. The intermediate portion 22 offsets the divider tongue 18 from the attachment portion 14. The intermediate portion 22 also combines with an outer wall 24 of the attachment portion to define the paper clip 16 for securing a reorder tag to the divider, as discussed more fully hereinafter.

The H-shaped attachment portion 14 is located adjacent a corner portion of the divider tongue 18. Thus, depending on which set of the legs of the H-shaped attachment portion is engaged with the display wall, the divider tongue 18, in addition to being offset with respect to the attachment portion, will extend either in an upward or downward direction relative to the display wall 12. In a greeting card display, each stack of cards normally extends above the adjacent display walls; hence a divider tongue that extends slightly above the display wall can still function effectively to divide a display space into segments for the stack of cards.

Figure 7:
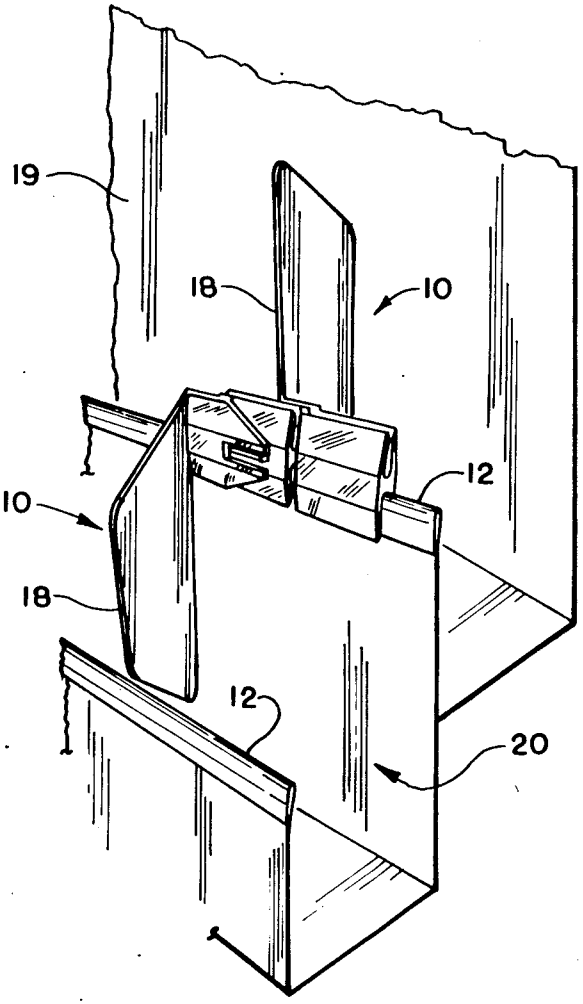
FIG. 7 is a schematic three dimensional illustration of the pair of dividers in the orientation of FIG. 6.

The sets of legs 14A, 14B of the H-shaped attachment portion are resiliently biased toward the position illustrated in FIG. 2. The spacing of the gripper portions 14D, 14E causes the associated legs to be resiliently spread apart when they are inserted over the upper end of a display wall, and the gripper portions 14D, 14E are resiliently urged against the opposite sides of the display wall, to hold the divider in place against the display wall. Importantly, as shown in FIG. 2, the gripper portions 14D, 14E are preferably offset from each other (i.e., they extend different distances from the central portion 14C of the attachment portion). Also, the sets of legs 14A, 14B of the H-shaped attachment member are bent toward each other. Such structure provides a cocking action that tends to cock the divider toward or away from the display wall, depending on which way the divider is oriented. For example, in FIG. 1, the two dividers whose tongues extend downward relative to the display wall are cocked in a rearward direction, with the divider tongues pressed firmly against one side of the display wall. That position is particularly useful in preventing greeting cards from becoming inadvertently wedged behind the dividers, which would adversely affect the neatness and the aesthetics of the display. When a divider is connected with the upper display wall, with the divider tongue extending upward and rearward (i.e., the orientation of the right hand divider of FIG. 7), the divider is cocked in a rearward direction, and is pressed against the back wall of the display. In FIG. 7, the back wall is schematically illustrated at 19. That prevents cards in the upper most display space from becoming located in positions in-between the positions set by the dividers. Thus, the cocking action provided by the offset gripper portions has been found useful in properly positioning stacks of cards in an aesthetically pleasing manner.

In the position of FIG. 1, the H-shaped attachment portions 14 are secured to the display wall of the merchandise display with their divider tongues 18 extending downward and into the display space 20 which is forward of the display wall. In that position, the divider tongues 18 are offset to one side of the attachment portion 14. It should also be readily apparent that by rotating either divider approximately 180° and then securing the same legs of the H-shaped attachment portion to the display wall, the divider tongue 18 would still extend downwardly from the attachment, but it would be located in the opposite display space 20 rearward of the display wall 12. In addition, by turning the H-shaped attachment means over, the divider tongue 18 can extend into either of the display spaces 20 on the opposite sides of the display wall with the divider tongue extending upward from the attachment portion rather than downward, as seen by the dividers shown in FIG. 7. Thus, it should be clear from the foregoing discussion that each divider can be placed in four different orientations relative to the display wall. It can be placed in orientations with the divider tongue extending into either of the display spaces 20 forwardly or rearwardly of the display wall. It can also be placed in orientations with the divider tongue in an upward or downward orientation relative to the attachment portion 14.

Figure 5:
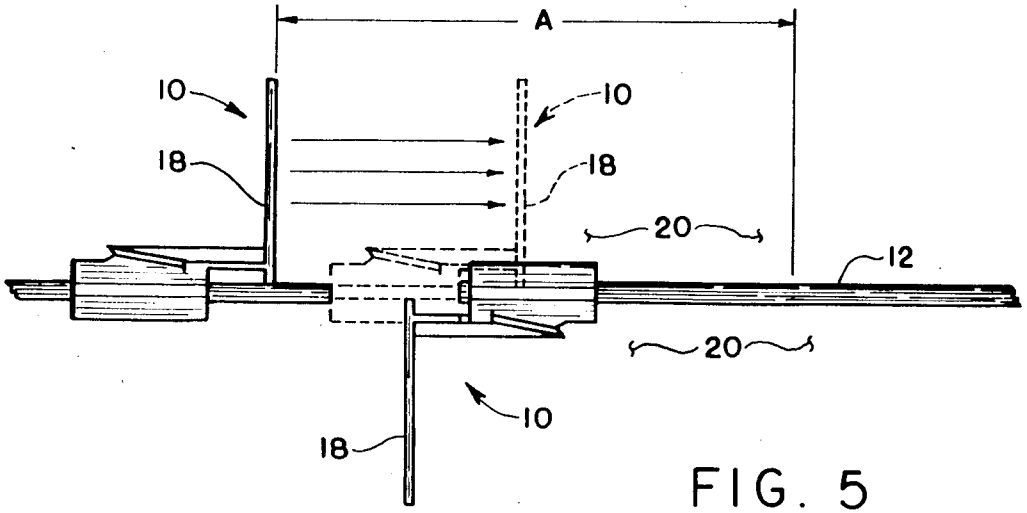
FIG. 5 is a schematic illustration of a pair of dividers secured to a display wall in certain of their respective orientations.
Figure 6:
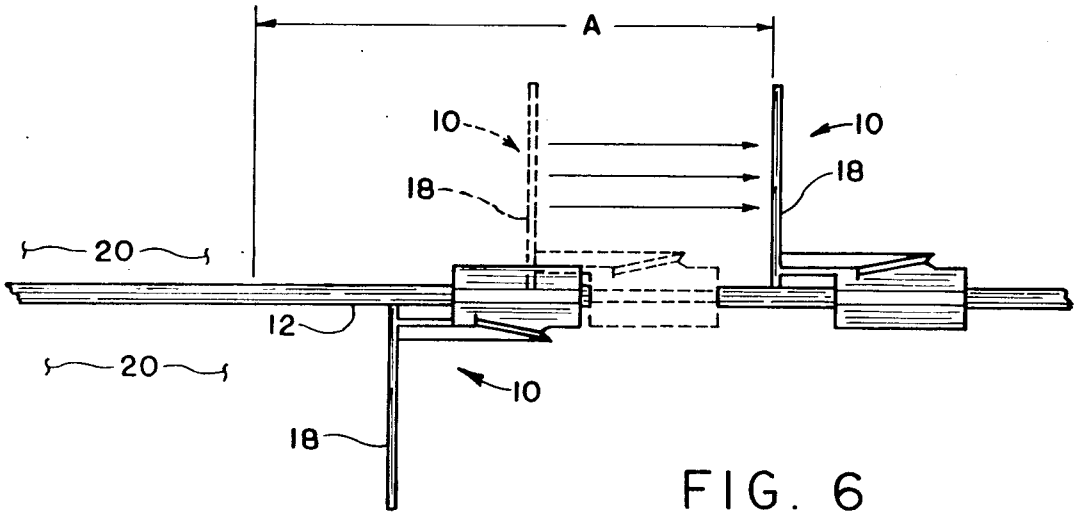
FIG. 6 is another schematic illustration of the pair of dividers secured the display wall in other of their respective orientations.

The foregoing structure of the divider further enables two dividers to be connected with one display wall with both dividers at any desired locations in the display spaces on the opposite sides of the display wall. FIG. 5 schematically illustrates a pair of the dividers on a single display wall, looking downward on the display wall 12, with the H-shaped attachment portions supporting the divider tongues in downward directions in the display spaces 20 on opposite sides of the display wall 12. FIG. 6 schematically illustrates the same dividers but with the H-shaped attachment portion of one of the dividers reversed, so that the divider tongue extends in an upward direction. FIG. 7 schematically illustrates, in three dimensions, the orientation of the dividers in FIG. 6. As should be clear, the relative orientations of the dividers shown in FIG. 5 enables the dividers to be disposed in any relative locations, on both sides of the display wall 12, over half of a certain area A; the relative orientations of FIG. 6 enables the dividers to be disposed in any relative locations, on both sides of the display wall over the remainder of that area A. Thus, the divider structure enables two of the tongues to be located at any desired locations on the opposite sides of a single display wall. Such a feature is very significant, because it enables a pair of divider tongues to be positioned in any desired locations over the entire display wall, thereby dividing the display spaces on both sides of that display wall into segments of predetermined sizes. Thus, all of the display spaces can be subdivided into segments of predetermined sizes, despite the fact that the back wall of the display is incapable of properly supporting a divider.

An additional feature of the divider of the invention is the paper clip structure 16 for positively supporting a reorder tag. As seen in the figures, the paper clip structure 16 is basically formed by the outer side surface 24 of the H-shaped attachment portion, and a clip member 32 extending from the intermediate portion 22 and disposed in juxtaposed relation to the outer side surface 24. The clip member 32 carries a pair of resilient, spaced apart fingers 32A, 32B with a rectangular gap 32C therebetween. The fingers 32A, 32B are biased toward the surface 24. The fingers 32A, 32B and the surface 24A are wedged apart by insertion of a sheet of paper between the fingers 32A, 32B and the surface 24, and the bias of the fingers causes them to engage and hold the sheet of paper against the surface 24. Also, in the preferred embodiment, the surface 24 has a raised portion 24A that extends into the rectangular gap 32C between the fingers 32A, 32B. As seen from FIG. 3, the fingers 32A, 32B have angular surfaces 34 which overlap part of the raised portion 24A. The raised portion 24A, coupled with the profile and resilient action of the fingers 32A, 32B, and the curved shape of the surface 24 causes a sheet of paper, such as a reorder tag, to be trapped between the fingers and the raised portion and bowed slightly in an outward direction when engaged between the fingers 32A, 32B and the surface 24. Such trapping and bowing of the paper has been found to be a desirable way of securing a sheet of paper such as a reorder tag.

As seen from the figures, the fingers 32A, 32B of the clip are an integral part of the intermediate member 22 which extends at a right angle to the divider tongue 18. The raised surface 24A of the clip is integrally formed on the attachment portion 14. Such structure enables the entire divider to be constructed as a single molded article, preferably molded out of a plastic material such as polypropylene. Furthermore, the design of the paper clip portion, especially the gap 32C between the fingers 32A, 32B enables the paper clip portion to be effectively molded while minimizing the size of the paper clip and the amount of material used to form the molded paper clip portion. Additionally, locating the attachment member 14 and the paper clip 16 at a corner of the divider tongue 18 is believed to minimize the amount of material required to mold the entire divider, which makes the divider both cost and material efficient.

Attached as Exhibit A is a set of engineering drawings for a divider according to the present invention.

What is claimed is:

1. Apparatus comprising a merchandise display including a display wall with display spaces defined on each side of the display wall, and a pair of identical dividers for dividing the display spaces into segments; each of the identical dividers having attachment means for engaging the display wall and a divider tongue extending longitudinally from the attachment means for extending into the display spaces for dividing the display spaces into segments; the attachment means and the divider tongues being designed to enable both divider tongues to extend simultaneously into the display spaces on each side of the display wall at any desired location over the entire length of the display wall.

2. A divider for attachment to a display wall, said divider comprising an attachment portion having a longitudinal extent and a divider tongue laterally and longitudinally off-set with respect to the attachment portion, the attachment portion comprising a pair of attachment means for engaging the display wall, the pair of attachment means enabling the divider to be reversibly attached to the display wall with the divider tongue selectively extending toward either side of the display wall and laterally and longitudinally off-set respect to the attachment portion such that when the divider tongue extends to one side of the display wall the divider tongue extends longitudinally downward from the attachment portion and when the divider tongue extends to the other side of the display wall the divider tongue extends longitudinally upward from the attachment portion.

3. A divider for attachment to a display wall, comprising a molded plastic article having an attachment portion for engaging the wall, a divider portion for dividing a display space into segments and a paper clip portion for engaging a sheet of flexible material; said paper clip portion comprising a pair of resilient spaced apart fingers which are biased toward a surface of said attachment portion resiliently to engage a portion of a sheet of flexible material and to hold the portion of the sheet of flexible material against said surface of said attachment means.

4. Apparatus comprising a merchandise display including a display wall having display spaces defined on each side of the display wall, and a pair of dividers for dividing the display spaces into segments; each of the dividers having attachment means for engaging the display wall and a divider tongue for extending into the display spaces for dividing the display spaces into the segments; the attachment means of each of the dividers comprising a generally H-shaped member having opposite pairs of legs for engaging the display wall and for supporting the divider from the display wall with the divider tongue extending into the display space on one side of the display wall; the attachment means and the divider tongues of the pair of dividers being designed to enable both of the divider tongues to extend into the display spaces on opposite sides of the display wall at ay desired location over the entire length of the display wall.

5. A divider for attachment to a display wall, said divider comprising an attachment portion having a longitudinal extent and a divider tongue laterally and longitudinally off-set with respect to the attachment portion, the attachment portion comprising an H-shaped member having opposite pairs of legs for engaging the display wall and for supporting the divider from the display wall with the divider tongue extending toward one side of the display wall, the opposite pairs of legs enabling the divider to be reversible attached to the display wall with the divider tongue selectively extending toward either side of the display wall and laterally and longitudinally off-set with respect to the attachment portion.

6. A divider for attachment to either side of a display wall, said divider comprising an attachment portion and a divider tongue extending longitudinally from the attachment portion, the attachment portion comprising first attachment means for engaging the display wall such that the divider tongue extends longitudinally upward from the attachment portion to one side of the divider wall and second attachment means for engaging the display wall such that the divider tongue extends longitudinally downward from the attachment portion on the other side of the display wall.

7. An apparatus comprising a merchandise display including a display wall with display spaces defined on each side of the display wall, and a pair of identical dividers for dividing the display spaces into segments; each of the identical dividers having an attachment portion and a divider tongue extending longitudinally from the attachment portion; said attachment portions and said divider tongues of said dividers being designed to extend simultaneously into the display spaces on each side of the display wall at any desired location over the entire length of the display wall, said attachment portions of each of the dividers including first attachment means for engaging the display wall with the divider tongue n one side of the display wall such that the divider tongue extends longitudinally upward from the attachment portion and second attachment means for engaging the display wall with the divider tongue on the other side of the display wall such that the divider tongue extends longitudinally downward from the attachment portion.

8. Apparatus as defined in claim 4 wherein the H-shaped member has a longitudinal extent, and wherein the divider tongue is offset longitudinally and laterally with respect to the H-shaped member.

9. Apparatus as defined in claim 8 wherein the divider tongue is a substantially planar member, and wherein the H-shaped attachment member is connected with a corner of the substantially planar member.

10. Apparatus as defined in claim 9 wherein a paper clip is connected with each divider, the paper clip being located between the divider tongue and the H-shaped attached member.

11. Apparatus as defined in claim 10 wherein each of said dividers comprises an integrally molded plastic article.

12. A divider as defined in claim 5 wherein each pair of legs has a distal end defining a gripping portion for engaging one side of a display wall, and wherein the gripping portions of each pair of legs are differently spaced from a central portion of the attachment member, to provide a cocking force on the divider tongue when the divider is secured to a display wall.

13. A divider as defined in claim 12 wherein the divider tongue is a substantially planar member, and wherein the H-shaped attachment member is connected with a corner of the substantially planar member.

14. A divider as defined in claim 13 wherein a paper clip is disposed between the divider tongue and the H-shaped attachment member.

15. A divider as defined in claim 14 wherein said divider comprises an integrally molded plastic article.

16. A divider as defined in claim 5 wherein the divider tongue is a substantially planar member, and wherein the H-shaped attachment member is connected with a corner of the substantially planar member.

17. A divider as defined in claim 16 wherein a paper clip is disposed between the divider tongue and the H-shaped attachment member.

18. A divider as defined in claim 17 wherein said divider comprises an integrally molded plastic article.

19. A divider as defined in claim 3 wherein said resilient fingers have a rectangular gap therebetween, and said surface of said attachment member includes a raised portion extending into the gap between said fingers.

20. A divider as defined in claim 19 wherein said attachment member is H-shaped, and said surface of said attachment member is curved to produce a predetrmined bow in a sheet of paper supported thereby.

21. A divider as defined in claim 20 wherein said divider includes a substantially planar divider tongue with a plurality of corners, and wherein said resilient fingers are formed on a member connected with a corner of said divider tongue, and extending generally perpendicular to the plane thereof.

22. A divider as set forth in claim 6 wherein the divider tongue is laterally off-set with respect to the attachment portion.

23. A divider as set forth in claim 22 wherein the divider tongue is rigidly affixed to the attachment portion.

24. A divider as set forth in claim 23 wherein the attachment portion comprises an H-shaped member and the first attachment means comprises a first pair of legs and the second attachment means comprises a second pair of legs disposed opposite the first pair of legs.

25. An apparatus as set forth in claim 7 wherein the attachment portion of each of the dividers comprises an H-shaped member and the first attachment means comprises a first pair of legs and the second attachment means comprises a second pair of legs disposed opposite the first pair of legs.

26. An apparatus as set forth in claim 25 wherein the divider tongue of each of the dividers is rigidly affixed to and laterally off-set with respect to its respective attachment portion.

* * * * *

UNITED STATES PATENT AND TRADEMARK OFFICE

CERTIFICATE OF CORRECTION

PATENT NO. : 4,796,764

DATED : January 10, 1989

INVENTOR(S) : Stephen N. Hardy

It is certified that error appears in the above-identified patent and that said Letters Patent is hereby corrected as shown below:

Column 7, line 16, delete "ay" and insert --any--.

Column 7, line 56, delete "n" and insert --on--.

Column 8, line 6, delete "attached" and insert --attachment--.

Signed and Sealed this

Second Day of May, 1989

*Attest:*

*Attesting Officer*

DONALD J. QUIGG

*Commissioner of Patents and Trademarks*